United States Patent [19]

Lugscheider et al.

[11] 4,423,512

[45] Dec. 27, 1983

[54] PLASMA MELTING FURNACE

[75] Inventors: Walter Lugscheider, Linz; Ernst Riegler, Enns; Ernst Zajicek, Ottensheim, all of Austria

[73] Assignee: Voest-Alpine Aktiengesellschaft, Linz, Austria

[21] Appl. No.: 336,899

[22] Filed: Jan. 4, 1982

[30] Foreign Application Priority Data

Jan. 8, 1981 [AT] Austria ..... 31/81

[51] Int. Cl.[3] ..... H05H 1/00

[52] U.S. Cl. ..... 373/22; 373/72

[58] Field of Search ..... 373/22, 23, 24, 72, 373/88, 90, 44, 54

[56] References Cited

U.S. PATENT DOCUMENTS

| | | | |
|---|---|---|---|
| 1,271,093 | 7/1918 | Snyder | 373/72 |
| 3,717,713 | 2/1973 | Schlienger | 373/72 |
| 4,101,725 | 7/1978 | Shelepov | 373/18 |
| 4,137,422 | 1/1979 | Barbashin et al. | 373/72 X |

*Primary Examiner*—Roy N. Envall, Jr.

*Attorney, Agent, or Firm*—Brumbaugh, Graves, Donohue & Raymond

[57] ABSTRACT

A plasma melting furnace includes a water-cooled bottom electrode of copper and a temperature probe connected with the bottom electrode. A wearing part of steel is provided in the bottom of the furnace, covering the bottom electrode. At least one counter electrode is arranged at a distance above the wearing part for the formation of the plasma jet. In order to prevent the risk of a melting through of the bottom electrode as far as to its water-cooled section on account of a secondary arc, a metal layer is provided between the bottom electrode and the wearing part. The metal layer is formed by a metal having a low thermal conductivty and a low melting point, as compared to copper, as well as a high melting enthalpy. Preferably, a metal layer of lead or its alloys with tin and/or zinc is provided.

10 Claims, 3 Drawing Figures

PLASMA MELTING FURNACE

BACKGROUND OF THE INVENTION

The invention relates to a plasma melting furnace comprising a water-cooled bottom electrode of copper, a temperature probe connected with the bottom electrode, and a wearing part of steel covering the bottom electrode in the bottom of the furnace, at least one counter electrode for the formation of the plasma jet being arranged at a distance above the wearing part.

With a plasma melting furnace of this kind the plasma jet is led between the bottom electrode (anode) and the counter electrode(s) (cathode(s)). The water-cooled bottom electrode is supervised by a temperature measuring device, which means that the electrodes are switched off when exceeding a certain temperature in order to prevent a breakthrough of water into the steel bath of the furnace.

During a furnace campaign the refractory lining of the furnace gets worn, the wearing part at the bottom electrode melting off accordingly and shortening in the direction of the water-cooled bottom electrode. In case of a plurality of counter electrodes, the bottom electrode provides for the current of all plasma burners.

With the usual technical sizes of known plasma furnaces, the summation current of the bottom electrode amounts to between 10,000 and 50,000 A. What is decisive to the faultless functioning of the furnace is a good contact of the scrap or bath with the wearing part at the bottom electrode. In case of an insufficient electrical conductivity of the contact site in the region of the bottom electrode, secondary arcs may form between the scrap and the wearing part.

Towards the end of a furnace campaign it may furthermore happen that the refractory lining gets damaged in the immediate vicinity of the bottom electrode when the scrap sets. This may also lead to the formation of a secondary arc at the bottom electrode between a piece of scrap and the wearing part.

Secondary arcs of this kind may lead to a strong local overhearing of the wearing part and of the bottom electrode itself, thus creating the danger of a melting through of the entire bottom electrode (in the manner of a torch cut) as far as into the water-cooled section. In case of such a breakthrough, the cooling water, which is under pressure, would penetrate into the furnace below the molten bath and would lead to oxyhydrogen gas explosions, constituting a risk to the furnace and to the operating personnel. The process of melting through of the electrode takes place at a very high speed so that the temperature measuring means will not be able to give a warning signal in order to shut down the plant.

SUMMARY OF THE INVENTION

The invention has as its object to provide a furnace of the initially defined kind, in which the danger of a melting through of the bottom electrode as far as to its water-cooled section on account of secondary arcs is prevented.

This object is achieved according to the invention in that a metal layer of a metal having a low thermal conductivity and a low melting point, as compared to copper, as well as a high melting enthalpy, preferably a metal layer of lead or its alloys with tin and/or zinc, is provided between the bottom electrode and the wearing part.

Preferably, a metal layer of lead or zinc, cadmium, gallium, indium, tin, antimony or bismuth, or their alloys is provided either in the binary or in the compound system.

Suitably, the metal layer is situated on the front face of the bottom electrode.

According to a preferred embodiment, the metal layer is designed as a hood with a projecting edge flange surrounding the upper section of the bottom electrode.

The metal layer has a thickness of between 5 and 30 mm, preferably a thickness of about 20 mm.

According to a further preferred embodiment, the wearing part, the metal layer and the upper section of the bottom electrode are combined into a coherent construction unit by a connection part of a preferably L-shaped cross section.

BRIEF DESCRIPTION OF THE DRAWING

The invention will now be explained in more detail with reference to the accompanying drawings, wherein.

DESCRIPTION OF EXEMPLARY EMBODIMENT

Figure 1:
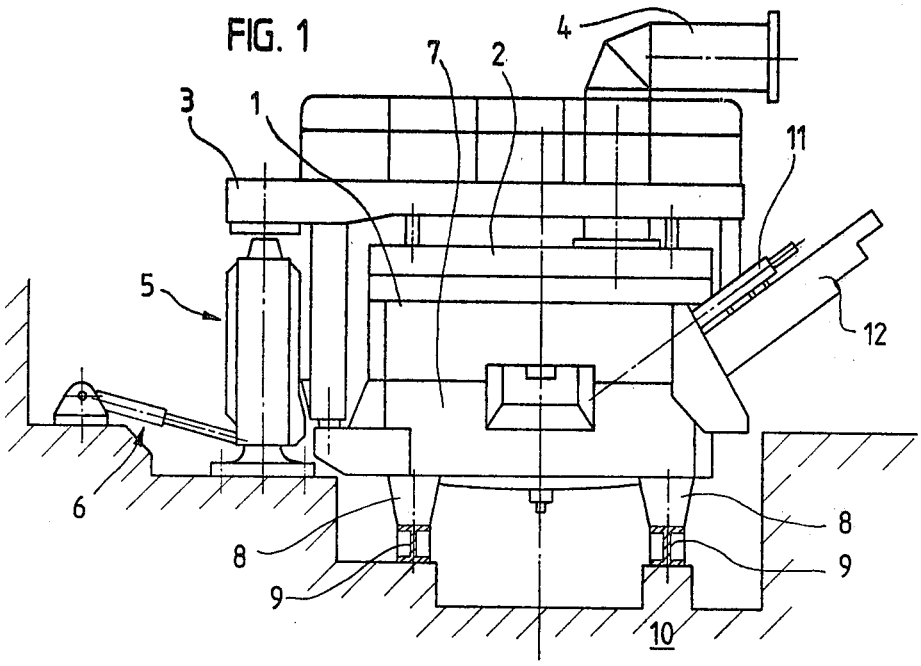
FIG. 1 is a side view of a plasma melting plant
Figure 2:
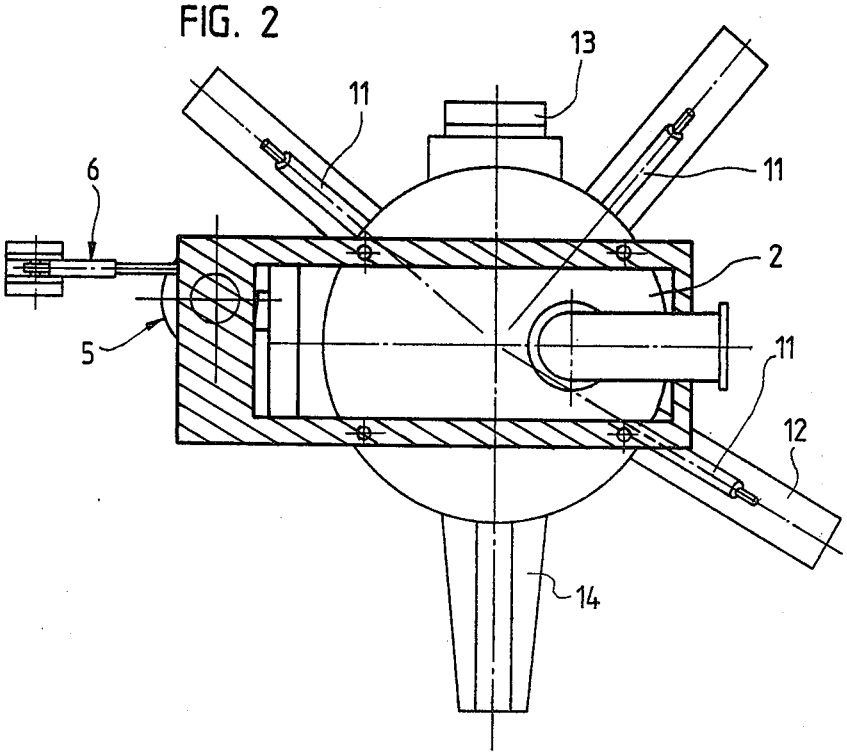
FIG. 2 is a plan view of the plasma melting plant illustrated in FIG. 1.
Figure 3:
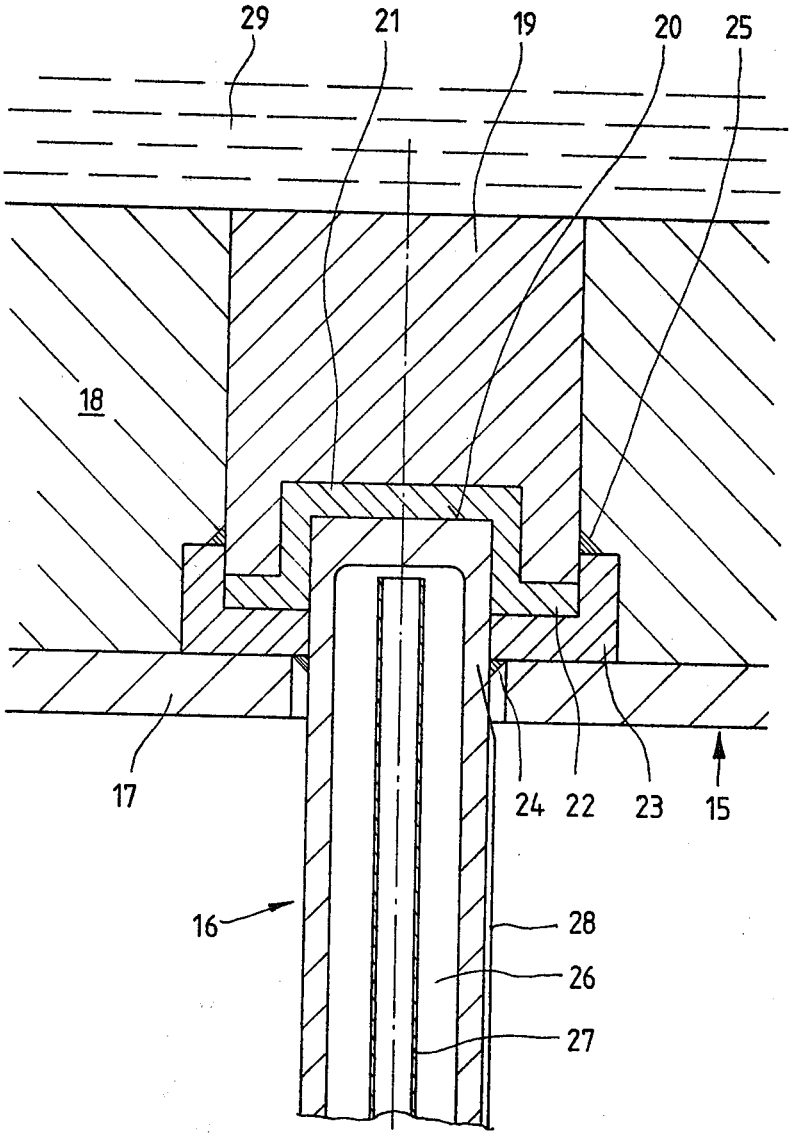
FIG. 3 represents a schematic section through the axis of the bottom electrode of the plasma melting plant.

A furnace upper section 1 of a plasma melting furnace, in particular a plasma primary melting furnace, is provided with a cover 2 carried by a cover carrying structure 3. From the cover a flue gas bend 4 projects to an exhaust (not illustrated). Laterally beside the furnace upper section 1 the cover lifting means 5 and the cover pivoting means 6 are arranged. The furnace lower section 7, via movable means 8, rests on running paths 9 supported on the base 10. Each of the three plasma burners 11 is displaceably mounted on an oblique burner mechanism 12. The slag door is denoted by 13 and the pouring spout is denoted by 14.

As can be seen from FIG. 13, the bottom electrode 16, which is arranged centrally in the bottom 15 of the plasma melting furnace, projects through the metal jacket 17 of the furnace into the interior of the same. The refractory lining 18 has a recess at this spot, which is closed relative to the bottom electrode 16 by a wearing part 19 of steel. Between the wearing part 19 and the front face 20 of the electrode, a metal layer 21 of a metal having a low thermal conductivity and a low melting point, as compared to copper, as well as a high melting enthalpy, preferably a metal layer of lead, is provided, which not only covers the front face of the electrode, but also peripherally surrounds the electrode on its end. An outwardly projecting edge flange 22 of this metal layer has an outer diameter that corresponds to the diameter of the wearing part 19.

For a safe connection of the wearing part with the bottom electrode, a connection part 23 with an L-shaped cross section is provided, which is fastened to the electrode by a welding seam 24 on the one hand and to the wearing part by a welding seam 25 on the other hand. Thereby the wearing part, the metal layer and the bottom electrode are combined into a construction unit.

Into the cavity 26 of the bottom electrode a cooling water supply tube 27 projects, through which cooling water under pressure is introduced. In the peripheral side wall of the electrode a temperature probe 28 is installed, which causes a switching off of the electrodes if the maximum permissible temperature has been exceeded. The steel melt present in the furnace is denoted by 29.

The task of the metal layer is the following: If a secondary arc forms, this arc, through the wearing part 19, will burn a channel that reaches to the metal layer 21, which in the embodiment illustrated is comprised of lead having a thickness of 20 mm, at the speed of a torch cut. Starting at the boundary surface of the lead layer 21, a substantially larger metal volume of the lead layer 21 is melted open than previously in the wearing part of steel, due to the thermal energy introduction of the secondary arc. Since the lead melts within a closed volume, the arc is extinguished by the liquid pressure of the molten metal in this region, a further progression of the melting through process thus being prevented.

The utilization of lead or its alloys with tin and/or zinc offers the particular advantage of being immiscible or only poorly miscible in the molten state with all steel iron materials for which a plasma furnace is used; thereby a mixing with the melt molten in the plasma melting furnace or its impurification are avoided.

The thickness of the metal layer depends on the thermodynamic properties of the metal used. In case of lead, a thickness of 20 mm has proved particularly advantageous. The layer thickness may be between 5 and 30 mm.

If the metal layer 21 between the water cooled electrode 16 and the wearing part 19 is not present, a strong local overheating will occur upon the formation of a secondary arc, whose range is relatively small, since the high thermal conductivity to the cooled region of the electrode very rapidly forms a solidification front.

Thereby the amount of molten metal available in the range of the heating local secondary arc is very small and there is no chance of the secondary arc being extinguished by the molten metal and of the melting channel being obstructed. The result of such a process is a free channel through the wearing part and the electrode material as far as to the cooling water region, similar to a separation cut followed by the penetration of water into the melt.

What we claim is:

1. In a plasma melting furnace of the type including a water-cooled bottom electrode made of copper, a temperature probe connected to said bottom electrode, and a wearing part of steel for covering said bottom electrode in the bottom of said plasma melting furnace, at least one counter electrode being arranged at a distance above said wearing part and adapted to form a plasma jet, the improvement comprising a metal layer provided between said bottom electrode and said wearing part, said metal layer being composed of a metal having a low thermal conductivity and a low melting point, as compared to copper, as well as a high melting enthalpy.

2. A plasma melting furnace as set forth in claim 1, wherein said metal layer comprises a material selected from the group consisting of lead, a lead alloy with tin, a lead alloy with zinc, and a lead alloy with tin and zinc.

3. A plasma melting furnace as set forth in claim 1, wherein said metal layer comprises materials selected from the group consisting of lead, zinc, cadmium, gallium, indium, tin, antimony, bismuth, and alloys thereof, in the binary system.

4. A plasma melting furnace as set forth in claim 1, wherein said metal layer comprises materials selected from the group consisting of lead, zinc, cadmium, gallium, indium, tin, antimony, bismuth, and alloys thereof, in the compound system.

5. A plasma melting furnace as set forth in claim 1, wherein said metal layer contacts the front face of said bottom electrode.

6. A plasma melting furnace as set forth in claim 1, wherein said bottom electrode has an upper section and said metal layer is designed as a hood surrounding said upper section, an edge flange projecting from said hood.

7. A plasma melting furnace as set forth in claim 1, wherein said metal layer has a thickness of between 5 and 30 mm.

8. A plasma melting furnace as set forth in claim 7, wherein said metal layer has a thickness of about 20 mm.

9. A plasma melting furnace as set forth in claim 1, wherein said bottom electrode has an upper section, and which further comprises a connection part for combining said wearing part, said metal layer and said upper section of said bottom electrode into a coherent construction unit.

10. A plasma melting furnace as set forth in claim 9, wherein said connection part has an L-shaped cross section.

* * * * *